US010378737B2

(12) United States Patent
Sanders et al.

(10) Patent No.: US 10,378,737 B2
(45) Date of Patent: Aug. 13, 2019

(54) LEAKY FEEDER LIGHT EMITTING DIODE LIGHTING SYSTEM

(71) Applicant: BECKER MINING AMERICA, INC., Barboursville, WV (US)

(72) Inventors: Gregory Allen Sanders, Glade Springs, VA (US); David Whitt, Hilton Head Island, SC (US); Larry Stallings, Gray, TN (US)

(73) Assignee: Becker Mining America, Inc, Abingdon, VA (US)

( * ) Notice: Subject to any disclaimer, the term of this patent is extended or adjusted under 35 U.S.C. 154(b) by 65 days.

(21) Appl. No.: 15/559,073

(22) PCT Filed: Feb. 25, 2016

(86) PCT No.: PCT/US2016/019470
§ 371 (c)(1),
(2) Date: Sep. 18, 2017

(87) PCT Pub. No.: WO2016/148862
PCT Pub. Date: Sep. 22, 2016

(65) Prior Publication Data

US 2018/0073707 A1 Mar. 15, 2018

Related U.S. Application Data

(60) Provisional application No. 62/133,608, filed on Mar. 16, 2015.

(51) Int. Cl.
*F21V 21/002* (2006.01)
*F21V 5/04* (2006.01)
(Continued)

(52) U.S. Cl.
CPC ..... *F21V 21/002* (2013.01); *F21V 5/04* (2013.01); *F21V 23/001* (2013.01);
(Continued)

(58) Field of Classification Search
CPC .... F21V 21/002; F21V 23/001; F21V 23/003; F21V 5/04; H05B 33/0803; H05B 33/0857
See application file for complete search history.

(56) References Cited

U.S. PATENT DOCUMENTS 6,261,119 B1 * 7/2001 Green ..... H01R 4/2408 439/411
2013/0157713 A1 6/2013 Stolarczyk
2014/0002211 A1 1/2014 Becker

FOREIGN PATENT DOCUMENTS

JP 07-263937 10/1995
JP 2013 031005 2/2013

OTHER PUBLICATIONS

PCT/US2016/019470, International Search Report, dated Feb. 25, 2016.

* cited by examiner

*Primary Examiner* — Karabi Guharay
(74) *Attorney, Agent, or Firm* — Phyllis K Wood; PK Wood Law Office

(57) ABSTRACT

Methods, systems and devices for using a LED lighting system to communicate an emergency, indicate a route/pathway and illuminate an area using an existing leaky feeder communications system. The LED lighting system is powered by and may be controlled by the leaky feeder communications system that delivers 2-way communications and data. The LED lighting may be used as area wall location lighting, directional pathway indication, and area illumination. Control of the lighting system may be localized or remotely activated through hard wire or wireless connections. The system may controls dimming, pulsing, brightness, sequencing, and changing LED color.

18 Claims, 9 Drawing Sheets

(51) Int. Cl.

| | |
|---|---|
| ***F21V 23/00*** | (2015.01) |
| ***H05B 33/08*** | (2006.01) |
| ***H05B 37/02*** | (2006.01) |
| *F21Y 115/10* | (2016.01) |

(52) U.S. Cl.
CPC ..... *F21V 23/003* (2013.01); *H05B 33/0803* (2013.01); *H05B 33/0857* (2013.01); *H05B 37/0272* (2013.01); *F21Y 2115/10* (2016.08)

LEAKY FEEDER LIGHT EMITTING DIODE LIGHTING SYSTEM

This application is the National Stage of International Application No. PCT/US2016/019470, filed on Feb. 25, 2016, which claims the benefit of priority to U.S. Provisional Application No. 62/166,608 filed on Mar. 16, 2015.

FIELD OF THE INVENTION

This invention relates to lighting, and in particular to systems, devices, and methods for providing a light source in an underground mine environment using an existing leaky feeder communications system that delivers two-way communications and data to support a LED lighting system powered by and controlled by the leaky feeder communications system.

BACKGROUND OF THE INVENTION

A leaky feeder system is a communication system used in facilities, on structures and in areas where 2-way communications signal coverage is poor. Typical applications include buildings, airplanes, mines and tunnels. A leaky feeder communication system consists of a head end base unit, coaxial cable, signal amplifiers and amplifier power supplies. The cable is routed throughout the area that needs signal coverage and "leaks" radio signal through gaps between the electrical shield(s). As the signal leaks, losing strength, the signal amplifiers, installed in line approximately every 1000-3000 feet, boost the signal for coverage down the next length of cable. Using this cascading technique, leaky feeder systems provide 2-way communications for miles. Users carry 2-way radios that transmit and receive through the leaky feeder system throughout the system as well as back to the head end unit for surface and remote locations.

During an emergency situation leaky feeder communications may be the only means of providing effective communications. The United States 2006 MINER Act amends the Federal Mine safety and Health Act of 2006 stating that underground mine operators must provide for post accident communication between underground and surface personnel via a wireless two-way medium within three years. This act required mines to install hundreds of leaky feeder communications systems throughout the United States and maintain these systems as mines continue to grow in length.

The leaky feeder base stations are connected to an Operations Center above ground. In the event of a disaster, leaky feeder systems are required to stay in operation, providing a means to communicate with personnel still underground. The personnel may be able to communicate, but there are virtually no lights in underground mines. The only lights available are personal head-lamps that use a re-chargeable battery sufficient for only 8-12 hours. There are no backup supplies of headlamps or underground charging stations. During an emergency event all power is disconnected to the mines to prevent an electrical ignition of methane so no alternative power is available. The leaky feeder system is required to stay energized to provide communications during the emergency event and is intrinsically safe meaning that the system is designed to prevent electrical ignitions of methane. With no power underground and head lamps having a limited charge the inevitable problem is total darkness for those still in the mine.

What is needed to overcome the problems associated in prior art of headlamps is the continuous availability of light for escape way marking, location indication and area lighting in facilities, structures and critically in mines and tunnels.

BRIEF SUMMARY OF THE INVENTION

A first objective of the present invention is to provide methods, systems and devices for providing an LED lighting system that may use the power and communications capabilities of the existing leaky feeder infrastructure to control location indication lighting independent of personal headlamps.

A second objective of the present invention is to provide methods, systems and devices for providing an LED lighting system that may use the power and communications capabilities of the existing leaky feeder infrastructure to control an emergency flash signal independent of personal headlamps.

A third objective of the present invention is to provide methods, systems and devices for providing an LED lighting system that may use the power and communications capabilities of the existing leaky feeder infrastructure to control escape way directional indication lighting independent of personal headlamps.

A fourth objective of the present invention is to provide methods systems and devices for providing an LED lighting system that may use the power capabilities of the existing leaky feeder infrastructure to power area lighting independent of personal headlamps.

The fifth objective of the present invention is to provide methods, systems and devices for providing an LED lighting system that may use the power and communications capabilities of the existing leaky feeder infrastructure to provide a source to recharge batteries and other devices.

The sixth objective of the present invention is to provide methods, systems and devices for providing an LED lighting system that may use the power and communications capabilities of the existing leaky feeder infrastructure to provide a device which may be removed and reassembled in other areas, without tools, dependent upon the lighting requirements a specific area.

The seventh objective of the present invention is to provide methods, systems and devices for providing an LED lighting system that may use the power and communications capabilities of the existing leaky feeder infrastructure to provide an environmental sealed device to keep any exposed cable from environmental contamination.

A first embodiment of the present invention provides a LED lighting system that includes a housing having a c-shaped recess in a bottom section for clipping over a coax cable and a recessed upper section with a hollow cylindrical structure extending through the housing, an electrical assembly including a LED mountable with the upper section of the housing, an elongated electrical terminal extendable into the hollow cylindrical structure to extend a distance into the c-shaped recess to puncture into the coax cable, the electrical terminal interfaced with the electrical assembly to supply electrical power from the coax cable through the electrical terminal to the electrical assembly for illuminating the LED when an electrical power is applied to the coax cable, and a cover with a lens over the LED.

The lighting electrical assembly can be operable over a range of electrical voltages between approximately 4Vdc and approximately 42Vdc. The coax cable is a leaky feeder communication system coax cable, and the electrical assembly includes a transceiver to receive an input signal from the leaky feeder communications system coax cable and a LED driver connected to the transceiver to control operation of the LED based on the input signal. The input signal can be selected from a group consisting of a dim to bright signal, a change color signal, and a sequential lighting signal or the electrical assembly can energize the LED as an area lighting.

The LED can be an array of LEDs or a series of light emitting diodes.

The screw connector can include a cap with an outer diameter greater than the inner diameter of the hollow cylindrical structure with the inner surface of the hollow cylindrical structure being threaded, and a threaded post extending from one side of the cap for mating engagement with the threaded hollow structure, a prong conductor with a pointed tip extending centrally through the threaded post with an insulator surrounding the prong conductor above the pointed tip, and a barrel conductor over the prong insulator extending to the cap such that as the cap is rotated the threaded post advances into the threaded hollow structure and the prong conductor contacts with and penetrates into the coax cable in the c-shaped recess to contact with the coax cable core while the barrel conductor contacts with the shield of the coax cable forming a path to provide an electrical source to the electrical assembly. The screw connector compresses the barrel and prong conductors in place to maintain electrical contact.

Electrically, the screw connector includes a first sliding contact in connected to the prong conductor, the first sliding contact connected to a collector ring and terminating with a first collector ring terminal as an electrical source path, and a second sliding contact connected to the barrel conductor, the second sliding contact connected to a second collector ring at one end and terminating with a second collector ring terminal at the opposite end as an electrical return path.

The housing can include a clamping eyelet on each side of the c-shaped recess for clamping the housing over the coax cable to compress the leaky feeder coax cable. The lens can be a diffuser lens to enlarge the illumination area by spreading or scattering the light beams, a diffuser lens to increase the illumination area by spreading or scattering the light beams, a collimator lens to focus or concentrate the light beams to form a brighter light, or a transparent lens.

Further objectives and advantages of this invention will be apparent from the following detailed description of preferred embodiments, which are illustrated in the accompanying drawings.

DETAILED DESCRIPTION OF THE INVENTION

Figure 1A:
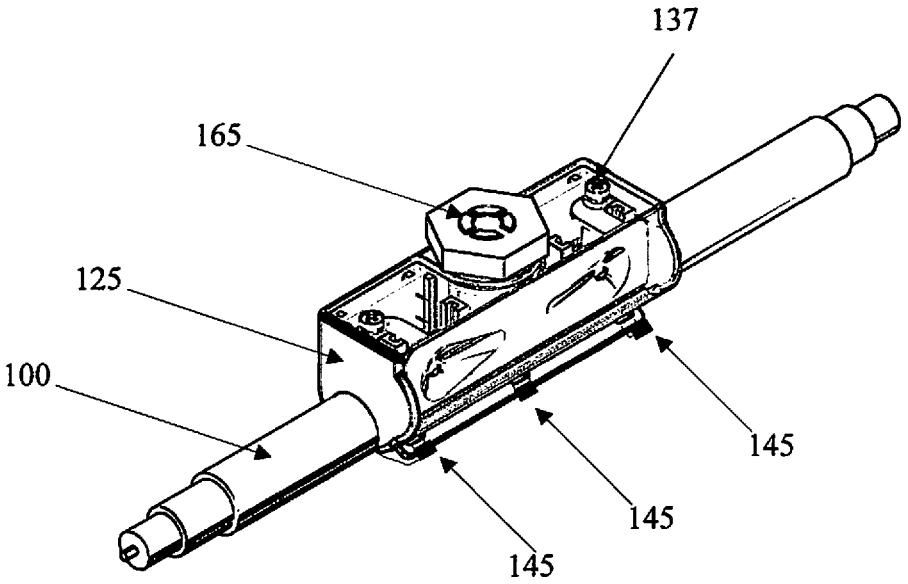
FIG. 1*a* is an isometric view of a covered LED lighting assembly mounted over a leaky feeder coax cable with the screw connector inserted.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of the reference numbers used in the drawings and the detailed specification to identify components:

100 leaky feeder coax cable
105 electrical core conductor
110 electrical shield
115 cable outer insulation jacket
120 cable inner insulation
125 base housing
127 housing internally threaded connector post
130 clamping eyelet
135 cover
137 mounting screws
140 cover internally threaded screw post
145 electrical wire tie
150 sliding contacts
155 collector rings
160 collector ring terminals
165 screw connector
170 threaded screw post
173 cap
175 barrel conductor
180 prong conductor
185 prong insulator
195 LED (light emitting diode)
200 LED board
205 LED transceiver board
210 LED driver board
220 lens
230 reflector panel A leaky feeder is a term for a communications system used in underground mining and other tunnel environments. In a leaky feeder communication system the coaxial cable run along tunnels and "radiates" and receives radio waves, functioning as an extended antenna. The cable is "leaky" in that it has gaps or slots in its outer conductor to allow the radio signal to leak into and out of the cable along its entire length. The signal is usually picked up by portable transceivers carried by personnel. Existing lighting improvements focus on improving the headlamps worn by the miners.

The leaky feeder LED lighting system of the present invention is configured to power a LED driver board to provide area lighting independent of personal headlamps. The present invention provides method, system and devices to communicate an emergency and illuminate an area using an LED lighting system uniquely connected to an existing leaky feeder communications system backbone. The LED lighting system is powered by and can be controlled by the leaky feeder communications system that delivers 2-way communications and data. The LED lighting assembly is capable of but not limited to area wall location, directional pathway indication, and area illumination.

Figure 1B:
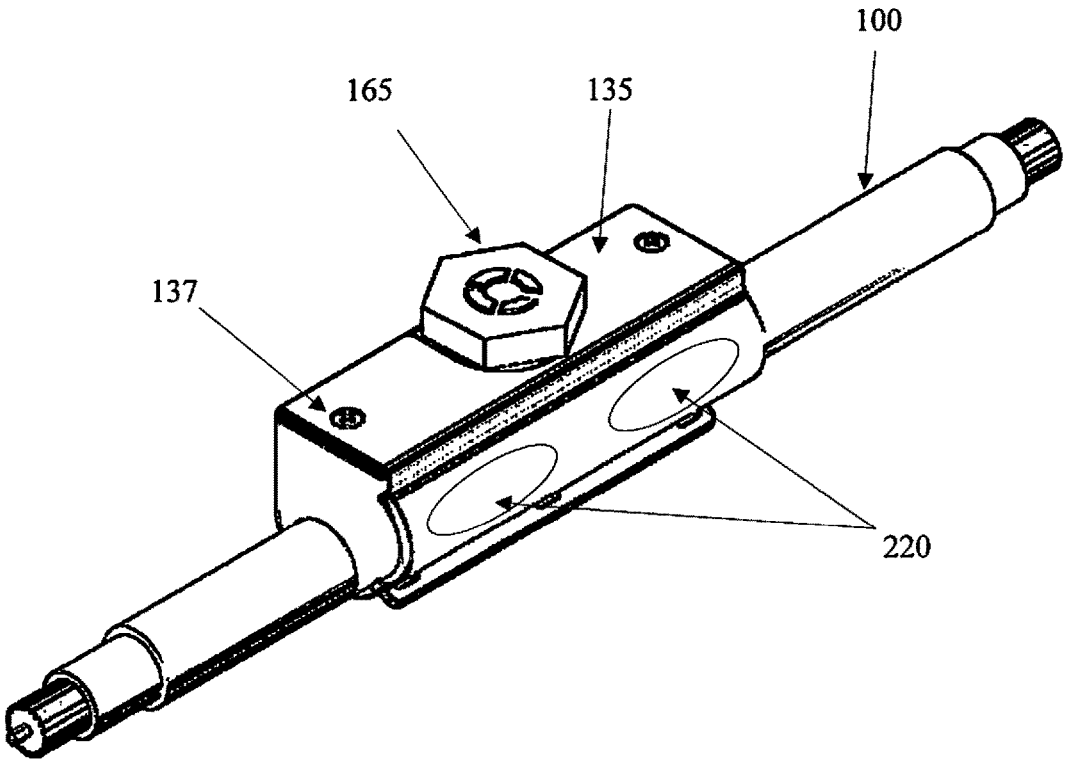
FIG. 1*b* is an isometric view of an uncovered LED lighting assembly mounted over a leaky feeder coax cable with the screw connector inserted.

FIGS. 1*a* and 1*b* show an isometric view of the LED lighting assembly mounted on the leaky feeder coax cable 100 with the screw connector 165 inserted and the assembly secured to the leaky feeder coax cable with electrical wire ties 145. FIG. 1*b* shows the lighting assembly with the cover removed to show the electrical assembly and the LEDs. When the LED assembly cover is attached as shown in FIG. 1*a*, the cover includes lenses over the LEDs. The c-shaped recess in the bottom of the base housing 125 is sized specific to the leaky feeder coax cable 100 outside diameter such that there is substantially no clearance around the parameter of the leaky feeder coax cable 100 after the LED lighting assembly has been snapped over the coax cable 100. This assures a tight fit to prevent the ingress of moisture and or contaminants. The electrical wire ties 145 further secure the LED lighting assembly in place to create a rigid mechanical connection to further seal the leaky feeder coax cable recess and prevent the leaky feeder coax cable 100 from flexing, creating a mechanically rigid, environmentally sealed attachment.

While the recess for the coax is shown and described as a c-shaped recess, those skilled in the art will understand that the recess can have an alternative configurations suitable for securing the LED lighting system to the coax cable.

Figure 2A:
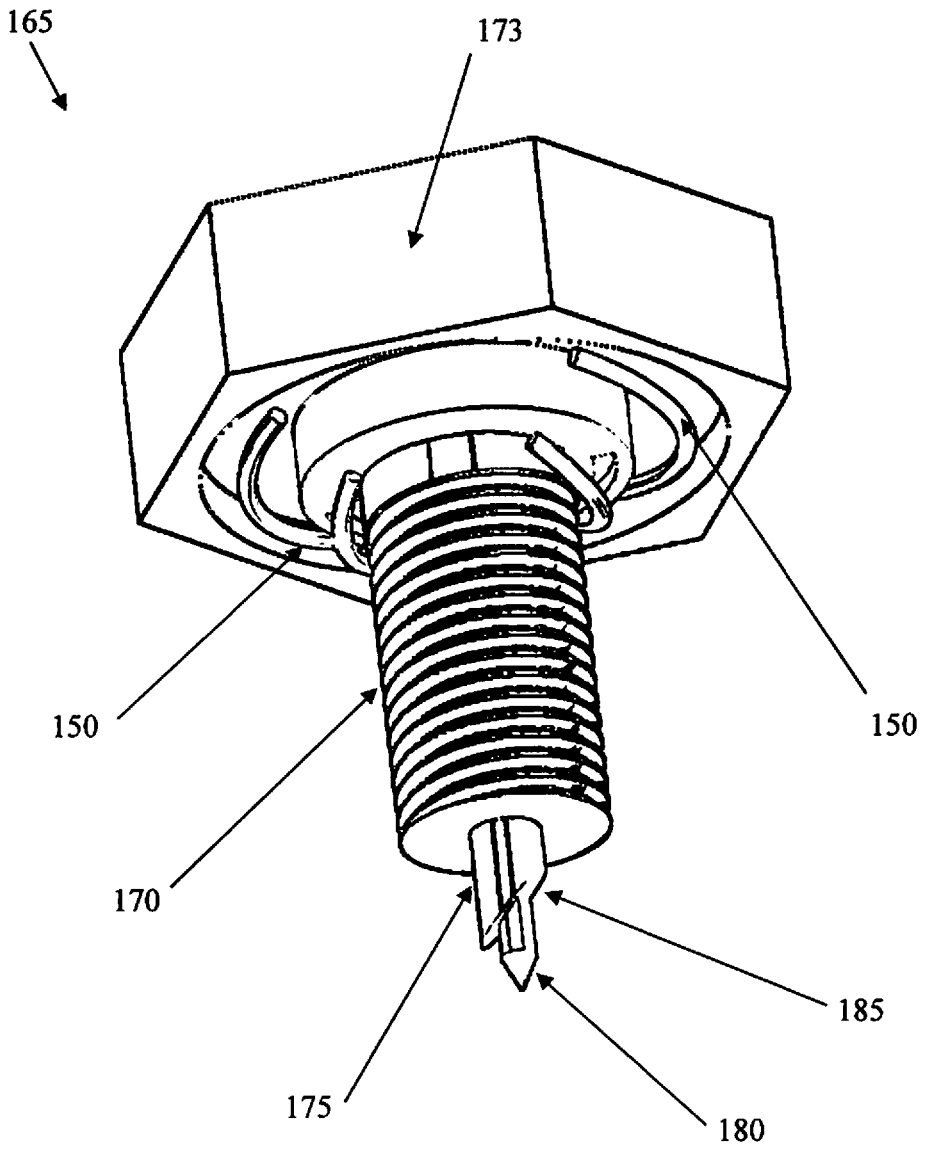
FIG. 2*a* is a perspective view of the screw connector showing the screw body, barrel conductor, prong conductor, prong insulator, prong insulator and the sliding contacts.

FIG. 2*a* shows a front perspective view of the screw connector 165 including the screw body 170 that includes a screw head and threaded portion extending from one side of the screw head. The barrel conductor 175 extends out of the end of the threaded portion of the screw body 170 with a prong conductor 180 extending from the barrel conductor. A prong insulator 185 surrounds the prong conductor 180 to insulate the prong conductor 180 from the barrel conductor 175. The screw connector 165 further includes sliding contacts 150 that are discussed below.

Figure 7:
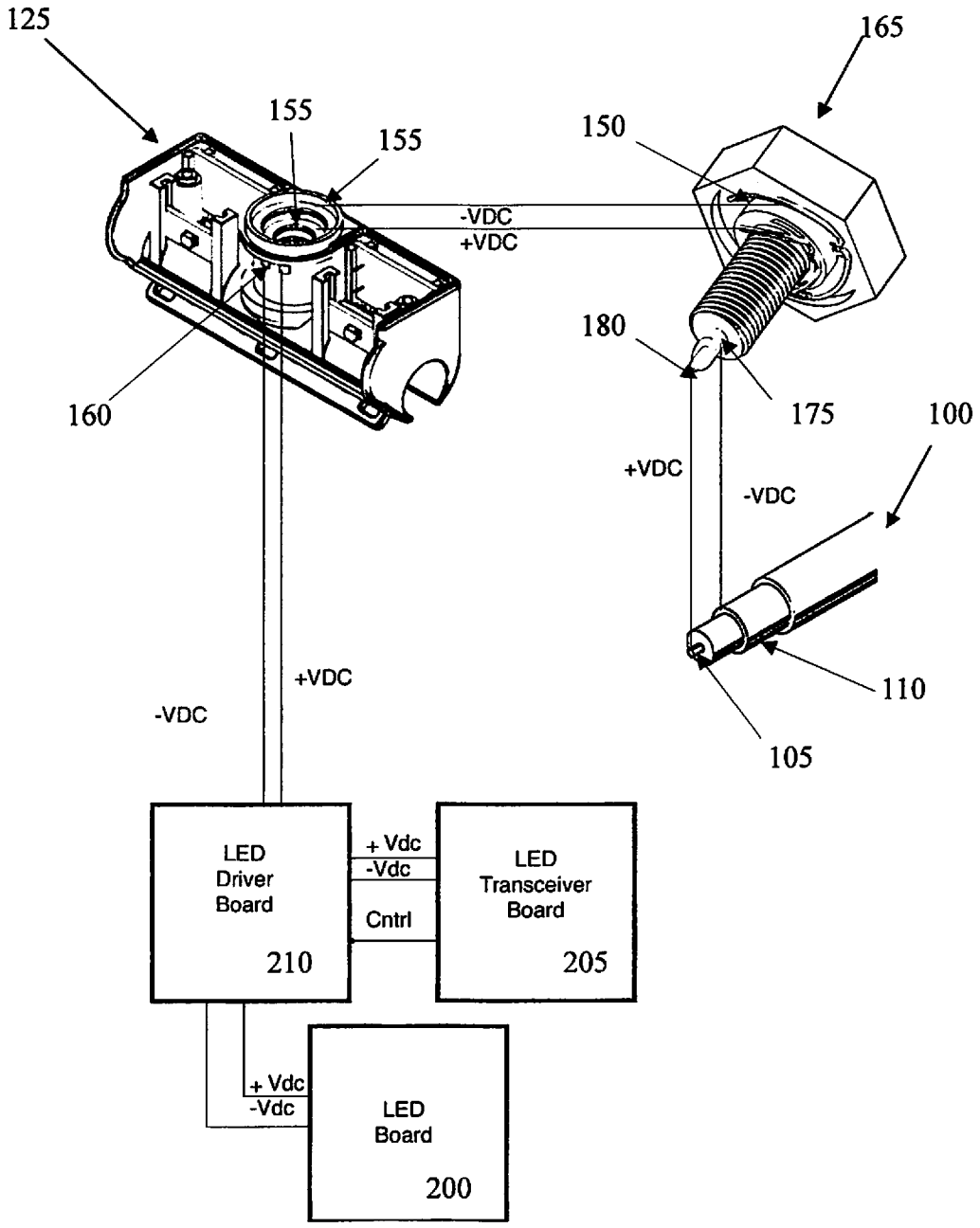
FIG. 7 is a schematic diagram of the transceiver board, LED driver board, LED board and leaky feeder coax cable electrical connections.

As shown, the screw body 170 houses the electrical connection components of the screw connectors 165. Referring to FIG. 7, electrically the barrel conductor 175 is configured to make electrical contact with one or more electrical shield strands 110 that run the length of the leaky feeder coax cable 100 providing the negative (−) DC electrical pole for the LED lighting assembly. The tension in the electrical shield 110 applies pressure on the barrel conductor 175 to maintain electrical conductivity. The prong conductor 180 makes electrical contact with the electrical core 105 of the leaky feeder coax cable 100 providing the positive (+) DC electrical pole to the LED lighting assembly. Source voltage can be derived from the communications system or through a separate source.

Figure 4:
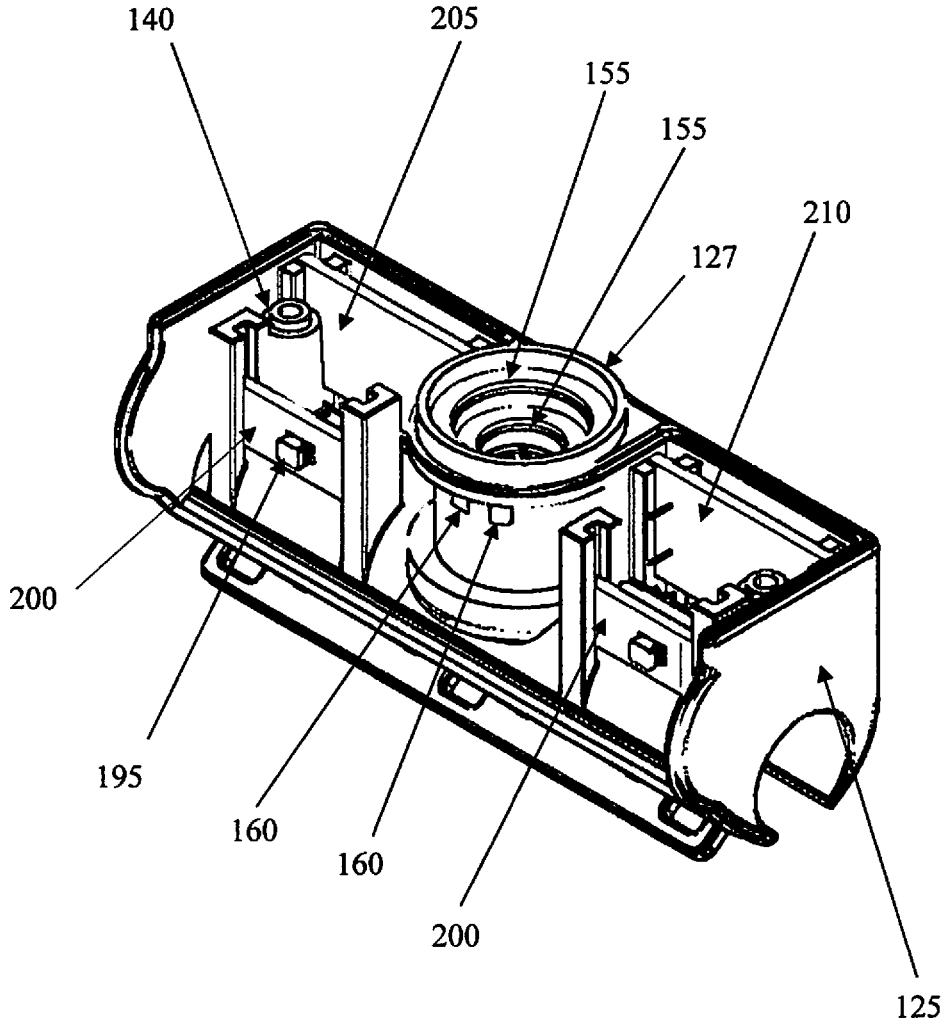
FIG. 4 is an isometric view of the LED lighting assembly with the screw connector and lenses removed to show the internal components.

The sliding contacts 150 shown in FIG. 2*a* make the connection from the barrel conductor 175 and the prong conductor 180 to the two collector rings 155 mounted in the base housing 125 as shown in FIG. 4 by pressing on the collector rings 155 when the screw connector 165 is tightened into the 125 base housing.

Figure 2B:
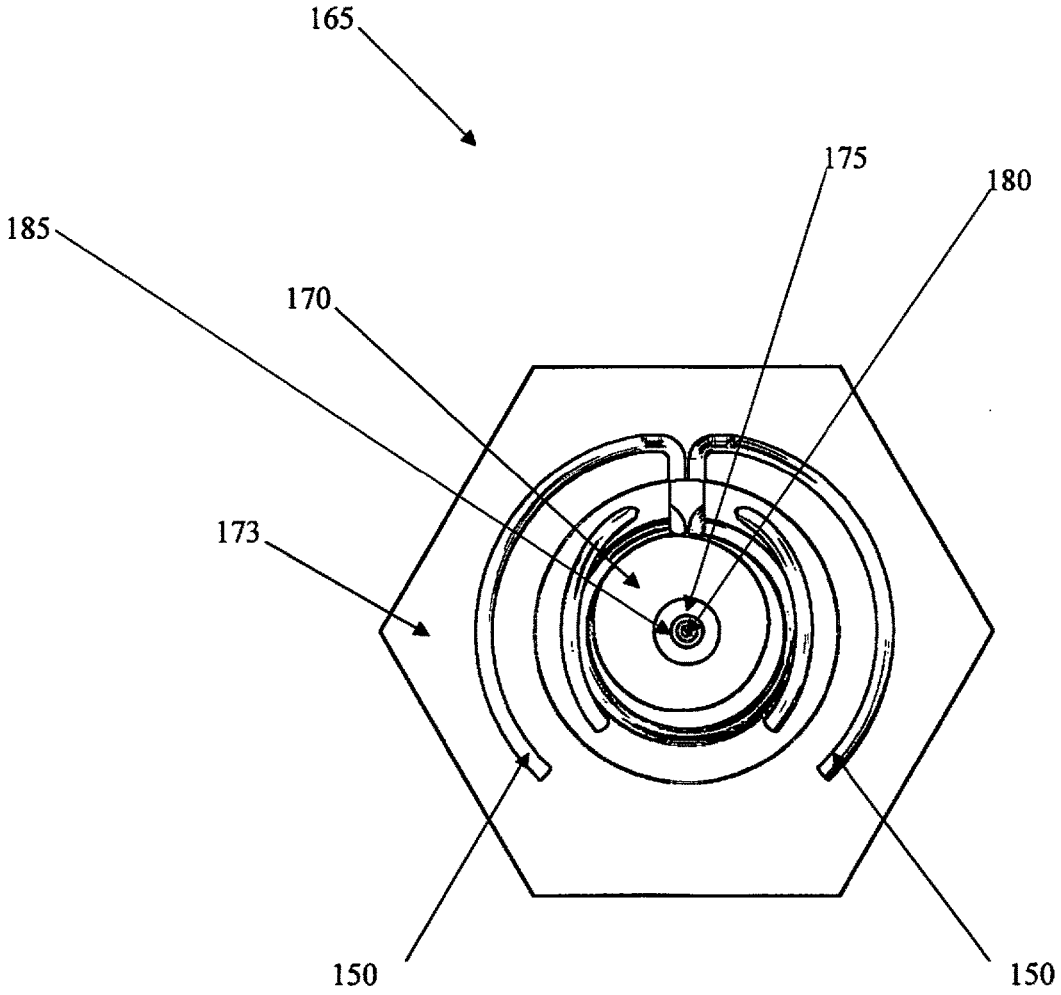
FIG. 2*b* is a bottom view of the screw connector.

FIG. 2*b* shows the bottom view of the screw connector 165 including the screw body 170 that includes a screw cap 173 and threaded screw post 177 extending from one side of the screw cap 173. The barrel conductor 175 extends out of the end of the threaded screw post 173 of the screw body 170 with a prong conductor 180 extending from the barrel conductor. A prong insulator 185 surrounds the prong conductor 180. The screw connector 165 further includes sliding contacts 150 that are discussed below.

Figure 3:
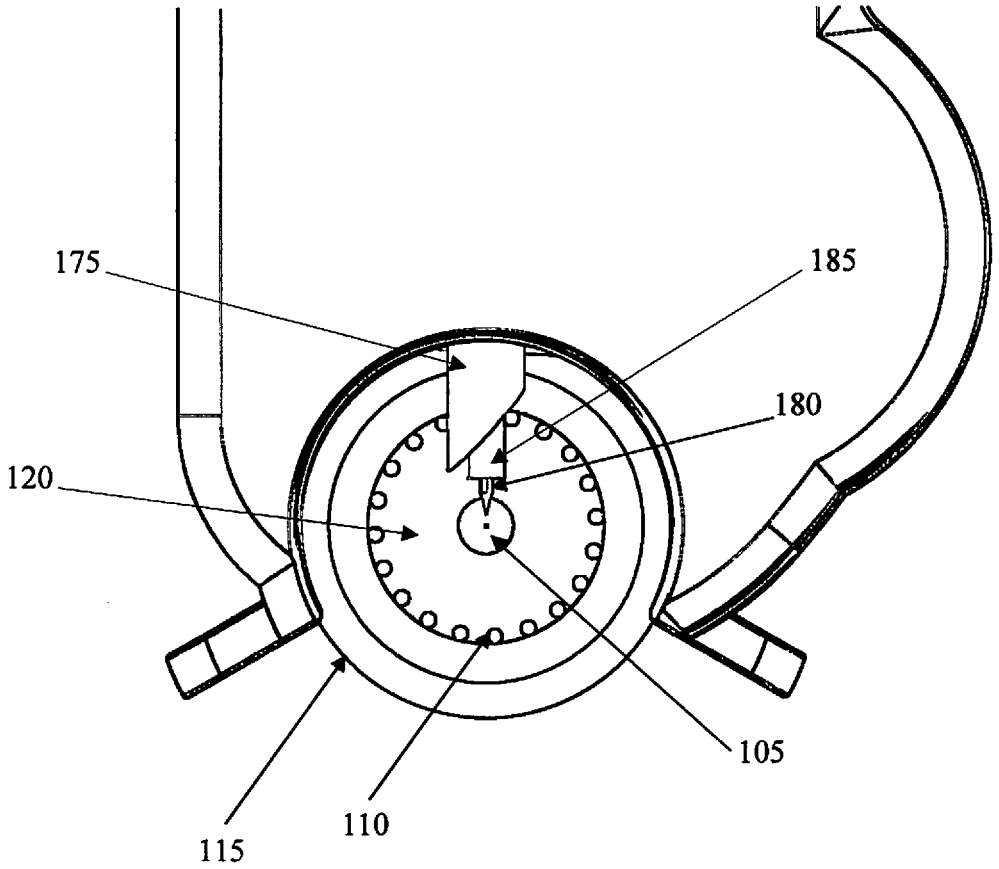
FIG. 3 shows the cross section view of the leaky feeder coax cable with the screw connector inserted therein.

FIG. 3 shows a cross section view of the leaky feeder coax cable 100 with the screw connector inserted therein. The prong insulator 185 provides an electrical barrier between the barrel conductor 175 and the prong conductor 180 to prevent short circuits and leakage current. The electrical connections from the leaky feeder coax cable 100 to the LED lighting assembly is reinforced by the mechanical compression load applied by the 165 screw connector threaded into the 125 base housing. When the user chooses to disable the assembly, a slug connector can be inserted to "plug" the hole in the coax cable insulation made by the screw connector. The slug connector can be similar in configuration to the screw connector without the sliding contacts.

Because the coax cable is used as a leaky feeder communication system, the installation of LED lighting assemblies increases the power requirement. Additional DC power supplies can be installed in parallel with the existing DC power supplies to provide the power necessary to power the LED lighting assemblies. The number of additional DC power supplies is based on the application. If the application is using low current escape way marking LED lighting assemblies, then fewer DC power supplies are required to be added compared to full area lighting which requires more power for more light. The spacing of LED lighting assemblies is dependent on the application as well. If the application is using escape way marking LED lighting assemblies the assemblies can be spaced 40-60 feet apart. If the application is using area lighting LED lighting assemblies then the assemblies may be spaced 20-40 feet apart.

FIG. 4 shows an isometric view of the LED lighting assembly with the screw connector 165 and lenses removed to show the internal components. The base housing 125 has a c-shaped recess to allow the housing to be mounted over the leaky feeder coax cable 100 as shown in FIG. 1. The base housing 125 includes mounting structures to mount the LED board 200, the LED transceiver board 205, and LED driver board 210 in the top recessed area. The a reflector panel 230 shown in FIG. 6 can snap in place in the base housing to collect and direct the light in different usable angles. The LED 195 is soldered to the LED board 200 and protrudes through the reflector panel 230. A cover assembly with lenses over the internal LEDs can snap in place over the base housing.

A collimator, diffuser or transparent lens can be mounted in the assembly cover. Alternatively, the assembly cover can be used as a diffuser, collimator or transparent lens. As shown in FIG. 4, the assembly cover can be held in place with screws in the base housing internally threaded screw post 140.

A diffuser lens can be used for area lighting by spreading or scattering the light over a larger area than the LED 195 would be able to illuminate independently, the light being approximately the same brightness at different angles to the personnel.

A collimator lens can be used for location indication lighting, emergency flash lighting or emergency exit directional indication lighting by focusing or concentrating the light so the light may be seen at a distance by the mine personnel.

In another example, a transparent lens can be used for location indication lighting, emergency flash lighting, escape way directional indication lighting or area lighting so the light may be seen at different angles at a distance by the personnel.

Figure 5:
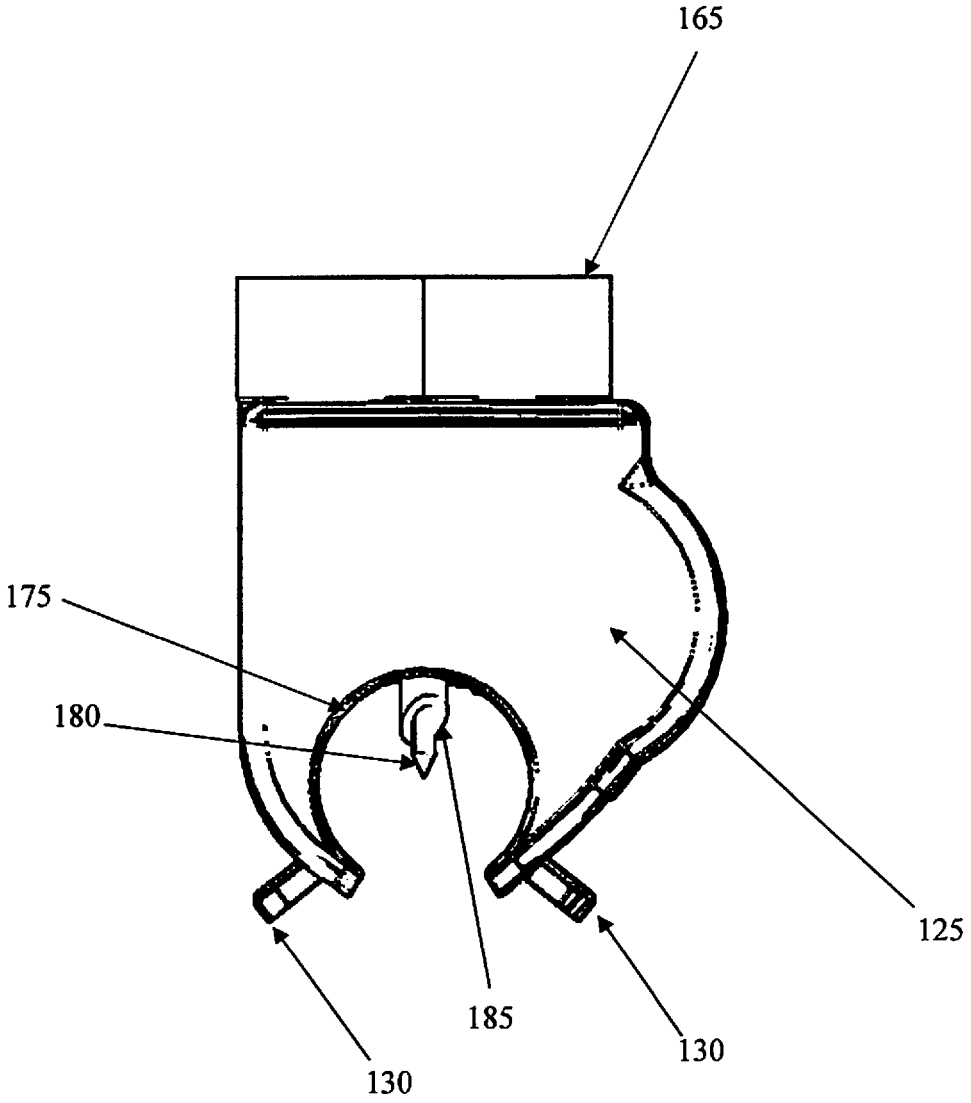
FIG. 5 is a side view of the LED lighting assembly with the screw connector installed.

FIG. 5 shows a side view of the LED lighting assembly with the screw connector 165 inserted in the threaded aperture. As shown, the barrel conductor 175 and prong conductor 180 protrude through the bottom of the base housing 125 to penetrate the leaky feeder coax cable 100 as shown in FIG. 3 to make contact with the electrical shield 110 and electrical core 105, respectively as the screw connector 165 is threaded into the internally threaded base connector post 127 in the base housing 125. Clamping eyelets 130 are located on the bottom of the base housing 125 to pass electrical wire ties 145 through and tighten after the base housing 125 is installed over the coax cable 100.

The c-shaped recess in the bottom of the 125 base housing is sized specific to the leaky feeder coax cable 100 outside diameter, such that there is substantially no clearance around the parameter of the leaky feeder coax cable after the LED lighting assembly has been snapped over the coax cable. This assures a rigid mechanical fit to prevent ingress of moisture and or contaminants. The electrical wire ties 145 further secure the LED lighting assembly in place to create a rigid mechanical connection to seal the leaky feeder coax cable 100 opening and prevent the leaky feeder coax cable 100 from flexing, creating a mechanical rigid, and environmentally sealed bond.

Figure 6:
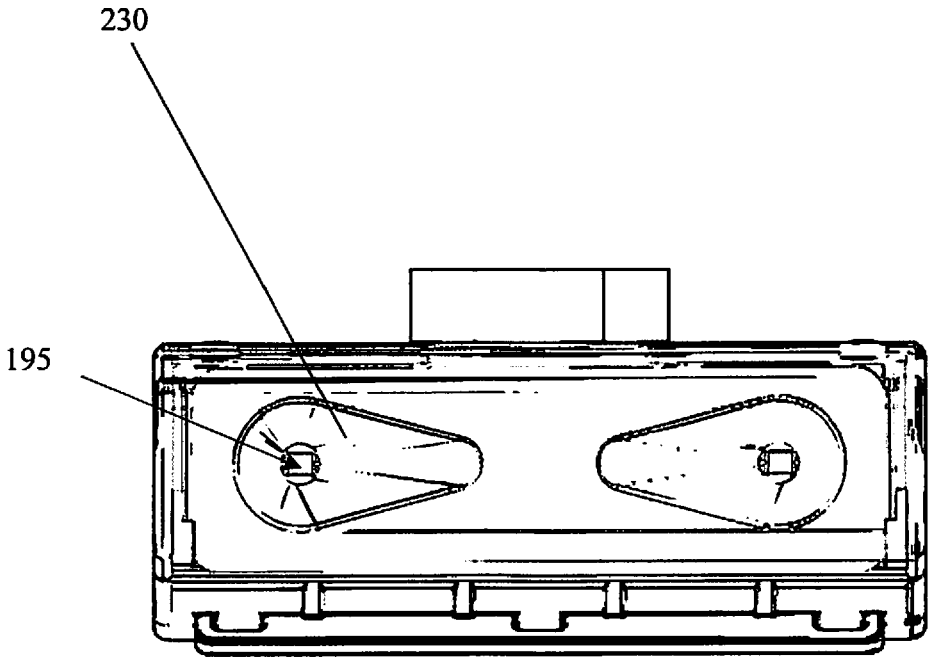
FIG. 6 is a perspective view of the LED lighting assembly isometric view with the reflector panel mounted on the base housing.

FIG. 6 is a top view of the LED lighting assembly showing the reflector panels 230 mounted on the base housing 125 over the LEDs. The reflector panels 230 reflect the light at usable angles. The lenses 220 in the cover 135 shown in FIG. 1*b* maximize the amount of light that is dispersed toward the personnel and may be defused or focused based on the type of lens used.

FIG. 7 is a schematic diagram showing the electrical components of the leaky feeder LED lighting system of the present invention. As shown, the system includes a transceiver board 205, a LED driver board 210, a LED board 200 and the leaky feeder coax cable 100. The leaky feeder coax cable 100 provides the power for the system. As previously described in regard to FIG. 3, the barrel conductor 175 makes electrical contact with the electrical shield strands 110 that run the length of the leaky feeder coax cable 100 to provide the negative (–) DC electrical pole for the LED lighting assembly. The tension in the electrical shield 110 strands applies pressure on the barrel conductor 175 to maintain conductivity. The prong conductor 180 makes electrical contact with the 105 electrical core conductor of the coax cable to provide the positive (+) DC electrical pole. The tension in the electrical core 105 provides pressure on the barrel conductor 175 to maintain conductivity.

Electrically, the coax core conductor 105 provides the (+) source current that passes through the prong conductor 180 in the screw post 177 connecting to a (+) slide contact 150. A (+) collector ring 155 in the internally threaded housing post 127 connects at one end with the (+) slide contact 150 and at the other end to the (+) collector ring terminal 160 to the LED assembly. Similarly, the electrical return path from the LED assembly makes contact with the (–) collector ring terminal 160 connected to the (–) collector ring 155. The (–) sliding contact 150 is connected to the (–) barrel conductor which is in contact with the coax shield 110 to complete the electrical path.

As shown in FIG. 4, the collector rings 155 are mounted inside the internally threaded connector post 127 of the base housing 125 and protrude as a collector ring terminal 160 to provide for connection to the LED driver board 210. The electrical connections between the LED lighting assembly and the leaky feeder coax cable 100 are reinforced by the mechanical compression load applied by the screw connector 165 threaded into the base housing 125 internally threaded connector post 127.

Referring back to FIG. 7, the LED driver board 210 regulates the voltage and current supplied to the LEDs 195 to control the illumination and optimize power consumption and provides regulated control power to the transceiver board. The LED board 200 also provides the structure for mounting the LEDs, for electrical connection and thermal cooling.

The LED driver board 210 may be configured to accept a range of input voltages between approximately 4 to approximately 42Vdc, which is impossible for prior art incandescent, fluorescent or other traditional lighting technologies due to their higher voltage requirements, but necessary since there is a span of voltage drop along the length of leaky feeder coax cable as the DC voltage drops due to cable resistance. The LED driver board controls the amount of current each LED consumes under different mine conditions. In the mining environment, safe electrical circuitry is required; the existing leaky feeder communications system power supply may be limited to 0.9-1.5 amps of DC current. Each LED may only consume between approximately 5 to approximately 50 milliamps each in order to provide the illumination necessary. The LEDs may be installed at distances along the 100 leaky feeder coax cable dependent on the application, which was entirely impossible when using prior art incandescent, fluorescent or other traditional lighting technologies due to their high current requirements.

The leaky feeder LED system can be configured for use in emergencies. When working in the underground mine, the miner may not be able to hear messages because they may be wearing hearing protection. The LED lighting system can include the following controls: dimming, pulsing, brightness, sequencing, and change colors. For example, the transceiver board can be configured to receive a radio frequency signal or data from the existing leaky feeder communications system and in response send a control command to the LED driver board to pulse the LEDs dim to bright to notify personnel to listen to their radio for an emergency message or to notify personnel of an emergency event. Control of the lighting system may be localized or remotely activated through hard wire or wireless connections. In another example, the system can send a control command to the LED driver board to change the LED color, for example from white to red or another color to notify of an emergency event. The system may also be used, for example, to sequence and cascade the LED's dim-to-bright to indicate the direction of escape using multiple LED lighting assemblies. In addition, the system may have segmented controls, and use different colors in different areas.

The leaky feeder LED lighting system may also be adapted to be used as a charging station in critical situations by connecting a charging adaptor to the screw assembly to allow personnel to keep critical batteries charged during an event.

In summary, the present invention provides methods, systems and apparatus to use LED lighting as a physical reference, to communicate an emergency, to indicate a route/pathway, or to illuminate an area using an LED lighting system uniquely connected to an existing leaky feeder communications system. The LED lighting system is powered by and can be controlled by the leaky feeder communications system that delivers 2-way communications and data. The LED lighting assemblies are capable of but not limited to, an area wall location, directional pathway indication, and area illumination.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended and their equivalents.

We claim:

1. A LED lighting system comprising:

a housing having a shaped recess for securing a coax cable and a recessed upper section with a hollow threaded screw post extending through the housing;

an electrical assembly including a LED mountable within the recessed upper section of the housing;

a threaded screw connector rotatable into the hollow threaded screw post to extend a distance into the shaped recess to puncture into the coax cable, the screw connector interfaced with the electrical assembly to supply electrical power from the coax cable through the screw connector to the electrical assembly for illuminating the LED when an electrical power is applied to the coax cable, wherein the coax cable is a leaky feeder communication system coax cable, the electrical assembly comprising:

a transceiver to receive an input signal from the leaky feeder communications system coax cable; and a LED driver connected to the transceiver to control operation of the LED based on the input signal; and a cover with a lens over the LED.

2. The lighting system of claim 1, wherein the electrical assembly is operable over a range of electrical voltages between approximately 4Vdc and approximately 42Vdc.

3. The LED lighting system of claim 1, wherein the input signal is selected from a group consisting of a dim to bright signal, a change color signal, and a sequential lighting signal.

4. The LED lighting system of claim 1, wherein the electrical assembly energizes the LED for area lighting.

5. The LED lighting system of claim 1, wherein the LED is an array of LEDs.

6. The LED lighting system of claim 1, wherein the LED is a series of LEDs.

7. The LED lighting system of claim 1, wherein the housing include a clamping eyelet on each side of the shaped recess for clamping the housing over the coax cable to compresses the leaky feeder coax cable.

8. A LED lighting system comprising:

a housing having a shaped recess for securing a coax cable and a recessed upper section with a hollow threaded screw post extending through the housing;

an electrical assembly including a LED mountable within the recessed upper section of the housing;

a threaded screw connector rotatable into the hollow threaded screw post to extend a distance into the shaped recess to puncture into the coax cable, the screw connector interfaced with the electrical assembly to supply electrical power from the coax cable through the screw connector to the electrical assembly for illuminating the LED when an electrical power is applied to the coax cable, wherein the screw connector comprises:

a cap having an outer diameter greater than the inner diameter of the hollow screw post;

a threaded screw shaft extending from one side of the cap for mating engagement with the threaded hollow screw post; and a prong conductor with a pointed tip extending centrally through the threaded screw shaft with an insulator surrounding the prong conductor above the pointed tip;

a barrel conductor over the prong insulator extending to the cap, as the cap is rotated the threaded screw shaft advances into the threaded hollow screw post and the prong conductor contacts with and penetrates into the coax cable in the shaped recess to contact with the coax cable core while the barrel conductor contacts with the coax cable shield forming a path to power the electrical assembly; and a cover with a lens over the LED.

9. The LED lighting system of claim 8, wherein the screw connector compresses the barrel conductor and prong conductor in place to maintain electrical contact.

10. The LED lighting system of claim 8, further comprising a first sliding contact connected to the prong conductor, the first sliding contact connected to a collector ring and terminating with a first collector ring terminal as an electrical source path; and a second sliding contact connected to the barrel conductor, the second sliding contact connected to a second collector ring at one end and terminating with a second collector ring terminal at the opposite end as an electrical return path.

11. The LED lighting system of claim 8, wherein the lens comprises:

a diffuser lens to enlarge the illumination area by spreading or scattering light beams.

12. The LED lighting system of claim 8, wherein the lens comprises:

a diffuser lens to increase the illumination area by spreading or scattering light beams.

13. The LED lighting system of claim 8, wherein the lens comprises:

a collimator lens to focus or concentrate the light beams to provide a brighter light.

14. The LED lighting system of claim 8, wherein the lens comprises:

a transparent lens.

15. A LED lighting device for use with a leaky feeder coaxial cable comprising:

a housing having a shaped area sized for clamping over the leaky feeder coaxial cable and an open recessed section with an internally threaded hollow cylindrical screw post extending to the shaped area of the housing;

an electrical assembly including a LED mountable within the upper section of the housing;

a threaded screw connector rotatable into the threaded hollow screw post to extend a distance into the shaped recess to puncture the leaky feeder coaxial cable, the screw connector interconnecting the electrical assembly with the leaky feeder coaxial cable core and shield to supply electrical power from the leaky feeder coaxial cable core through the screw connector to the electrical assembly for illuminating the LED when an electrical power is applied to the leaky feeder coaxial cable; and a cover with a lens to cover the open recessed section of the housing, the lens over the LED.

16. The LED lighting device of claim 15, wherein the threaded screw connector comprises:

a cap having an outer diameter greater than the inner diameter of the hollow cylindrical structure;

a threaded screw body extending from one side of the cap for mating engagement with the threaded hollow screw post;

a prong conductor with a pointed tip extending centrally through the threaded screw connector body with an insulator surrounding the prong conductor above the pointed tip;

a barrel conductor over the prong insulator extending to the cap;

a sliding prong contact connected to the prong conductor and a sliding barrel contact connected to the barrel conductor, the sliding prong contact and barrel contact exposed to make contact with a prong and a barrel collector ring terminals in the hollow screw post of the housing; and wherein as the cap is rotated the threaded screw connector advances into the threaded hollow screw post and the prong conductor contacts with and penetrates into the coax cable in the shaped recess to contact with the coax cable core while the barrel conductor contacts with the leaky feeder coax cable shield forming a path from the prong and barrel conductors to the prong and barrel sliding contacts and mating prong and barrel collector ring terminals to power the electrical assembly.

17. The LED lighting device of claim 16, wherein the prong and barrel collector ring in the threaded hollow screw post are connected to the electrical assembly.

18. The LED lighting device of claim 17, wherein the electrical assembly comprises:

a transceiver to receive an input signal from the leaky feeder communications system coax cable; and a LED driver connected to the transceiver to control operation of the LED based on the input signal.

* * * * *